US006403173B1

(12) United States Patent
Granger et al.

(10) Patent No.: US 6,403,173 B1
(45) Date of Patent: Jun. 11, 2002

(54) SEALING METAL CAP WITH PLASTIC INSERT

(75) Inventors: Jacques Granger, Libourne; Yves Peyrin, Chalon-sur-Saone, both of (FR)

(73) Assignee: Pechiney Emballage Alimentaire, Clichy (FR)

( * ) Notice: Subject to any disclaimer, the term of this patent is extended or adjusted under 35 U.S.C. 154(b) by 0 days.

(21) Appl. No.: 09/423,304

(22) PCT Filed: May 4, 1998

(86) PCT No.: PCT/FR98/00893

§ 371 (c)(1),
(2), (4) Date: Jan. 7, 2000

(87) PCT Pub. No.: WO98/51581

PCT Pub. Date: Nov. 19, 1998

(30) Foreign Application Priority Data

May 12, 1997 (FR) ..... 97 06009

(51) Int. Cl.[7] ..... B65D 41/40

(52) U.S. Cl. ..... 428/34.1; 428/34.1; 428/66.4; 428/355; 428/458; 215/218; 215/252; 215/295; 215/305; 215/347

(58) Field of Search ..... 425/458; 215/305, 215/295, 228, 252, 218, 347; 428/458, 66.4

(56) References Cited

U.S. PATENT DOCUMENTS

| | | | | |
|---|---|---|---|---|
| 3,303,953 A | | 2/1967 | Frank | |
| 3,587,898 A | * | 6/1971 | Northup | 215/40 |
| 3,637,103 A | * | 1/1972 | Ptak | 215/347 |

FOREIGN PATENT DOCUMENTS

| | | | | |
|---|---|---|---|---|
| GB | WO-9420237 | * | 9/1994 | B21D/51/50 |
| GB | WO94/20237 | * | 9/1994 | B21D/51/50 |
| WO | 94/20237 | | 9/1994 | |

* cited by examiner

*Primary Examiner*—C. Melissa Koslow
*Assistant Examiner*—Shalie Manlove
(74) *Attorney, Agent, or Firm*—Dennison, Schultz & Dougherty

(57) ABSTRACT

Sealing cap for closing screw top receptacles includes a metal cap having inner and outer surfaces, a threaded insert formed of a plastic material disposed within the metal cap and rigidly fixed to the inner surface thereof, and a coating bonded to at least a portion of the inner surface of the metal cap. The coating contains plastic material in a divided state and is heat sealed to the insert.

14 Claims, 3 Drawing Sheets

SEALING METAL CAP WITH PLASTIC INSERT

FIELD OF THE INVENTION

The invention relates to the domain of sealing metal caps, and more particularly to sealing metal caps with threaded plastic inserts adapted to glass screw tops. These caps are designed particularly for closing receptacles, flasks and bottles containing alcohol and spirit.

DESCRIPTION OF RELATED ART

State of the Art

Sealing caps with plastic inserts, typically SUPALUXE® caps marketed by the applicant, consist of a metal cap, a plastic insert, and possibly a seal if the insert itself does not perform the sealing function.

The plastic insert is assembled inside the metal cap by force fitting the insert into the metal cap.

FIG. 2 shows a typical cap according to the state-of-the-art with an add-on seal. As can be seen in the figure, the major advantage of this type of cap is that the outer metal cap itself is not threaded, which improves the esthetic quality of the cap and packaging, typically a flask or a bottle. Furthermore, the threaded plastic insert can be used for a large number of closing/opening cycles, therefore screwing/unscrewing cycles, without changing the geometry of the cap, which is an essential requirement for receptacles containing alcohols and spirits.

The problem that arises with these caps is essentially related to unscrewing the cap, particularly when the contents of the receptacle contain sugar or any other product that could crystallize. Crystallization of the sugar contained in the liquid in the bottle can prevent the plastic insert from sliding around the glass top, such that when an attempt is made to unscrew the cap, the metal cap slides on the insert, since cohesion between the glass top and the insert is greater than cohesion between the metal cap and the insert, which makes it impossible to open the bottle.

An attempt was made to solve this problem by increasing the limiting torque at which the metal cap and the insert separate in rotation. The applicant attempted to do this by reducing the tightening clearance between the insert and the metal cap, increasing the roughness of surfaces in contact, modifying the nature of the insert, and adding an adhesive or hot-melt coat between the metal cap and the insert. These measures do not solve the problem that arises.

SUMMARY OF THE INVENTION

According to the invention, the sealing cap with a plastic insert for closing screw top receptacles comprises a metal cap composed of a head and a skirt, a plastic insert, placed inside the said metal cap and rigidly fixed to it by an attachment means, and is characterized in that the said attachment means consist of a coat bonded to the said metal cap extending over all or part of the said metal cap facing the said insert, in that the said coat comprises the said plastic material in the divided state, and that it is heat sealed to the said insert.

Preferably, the said coat extends over the entire surface of the said metal cap facing the said insert.

If the said coat covers the entire inside surface of the said metal cap, problems can arise when closing the bottle due to the fact that the final cap is unable to slide.

The solution found by the applicant considerably increases the sliding torque of the insert inside the metal cap, typically multiplying it by a factor of 6. This torque measured according to standard NF H 35103 is increased from 17 lbs.inch (1.9 N.m) to more than 100 lbs.inch (11.3 N.m).

The means according to the invention provide a complete solution to the problem that arises. No separation was ever observed between the insert and the metal cap with any of the caps made according to the invention, even with very crystallized sugar deposits.

BRIEF DESCRIPTION OF THE DRAWINGS

FIG. 3 shows a sectional view of the "internal" varnishing on a coiled metal strip (7) with a varnishing machine comprising a varnishing roller (71) that dips in a liquid varnish tank (72) in order to form a coated metal strip (8), the varnish drying or baking means not being shown.

FIG. 4, which corresponds to FIG. 3, shows the next step in which the spot coating of the said bonding coat is applied on the coated metal strip (8). This could be done using a silk screen printing type technique with a cylindrical grid (81) with open or closed compartments depending on whether or not the liquid mix (82) is to be deposited on the coated metal strip (8) to form a strip (9) coated with the said coat (3) after drying or baking. The offset process can also be used to deposit a coat of varnish on predetermined parts of the strip (8).

Figure 3:
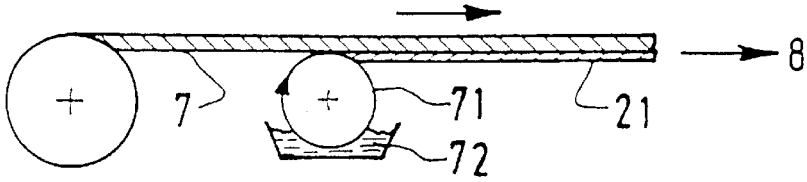
FIGS. 3, 4 and 5*a* to 5*e* illustrate the various steps in one method of making caps according to the invention.

As in FIG. 3, the liquid mix (82) drying or baking means are not shown.

Figure 4:
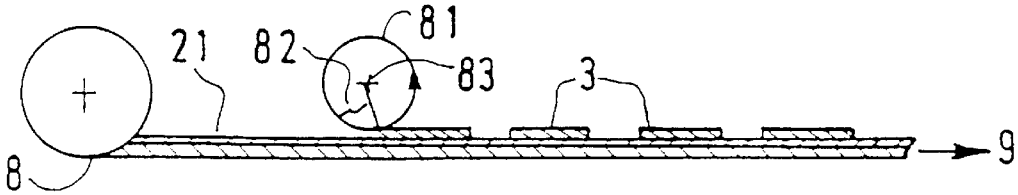
Figure 5A:
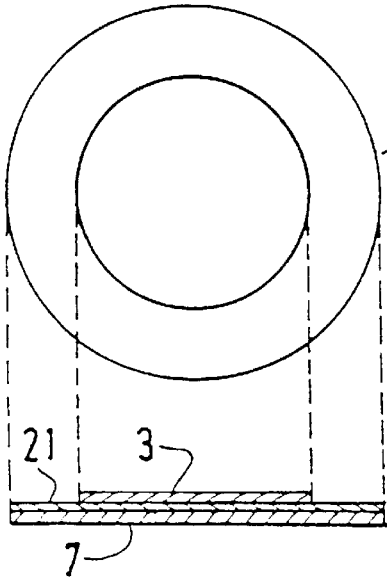

FIG. 5*a* is a sectional view from above showing the circular blank (900) cut out from the strip (9) obtained in FIG. 4 in order to be formed, typically by stamping and drawing.

Figure 5B:
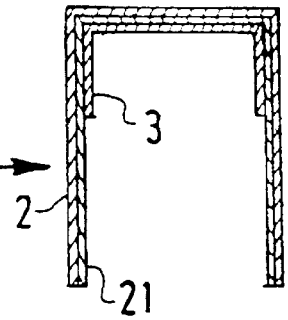

FIG. 5*b* shows an axial section of the metal cap (2) obtained by shaping the blank (900).

Figure 5C:
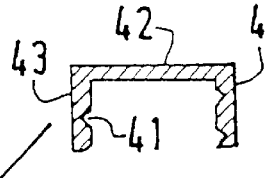
Figure 5D:
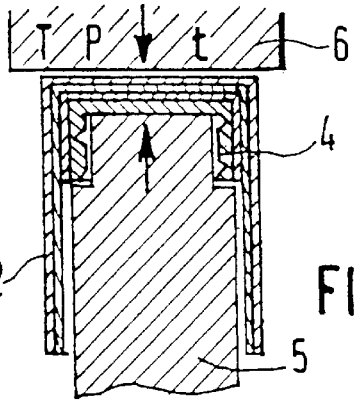

FIG. 5*d* shows a diagrammatic view of the metal cap assembly in FIG. 5*b* and an insert (4) by heat sealing using an assembly consisting of a punch (5) and a heating die (6) kept at a temperature T, exerting a pressure P for a time t.

Figure 5E:
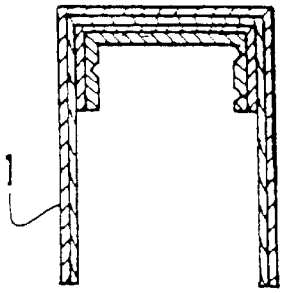

FIG. 5*e* diagrammatically shows a sectional view of the final cap (1) obtained according to the invention.

Figure 6:
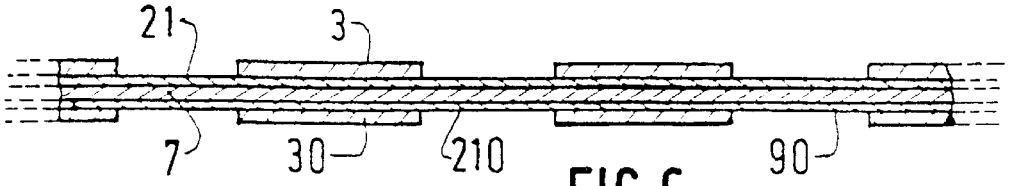

FIG. 6 shows a diagrammatic section of view of a second embodiment of the invention, in which the strip (90) corresponding to the strip (9) in the previous embodiment, comprises a coat (3) on one surface of the strip and another coat (30) on the other surface of the strip. In this case, the metal strip (7) is also covered by an external coating (210) similar to the internal coating (21).

Figure 7:
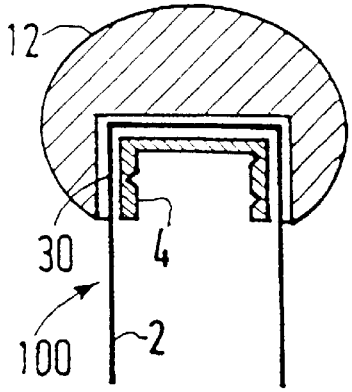
Figure 8:
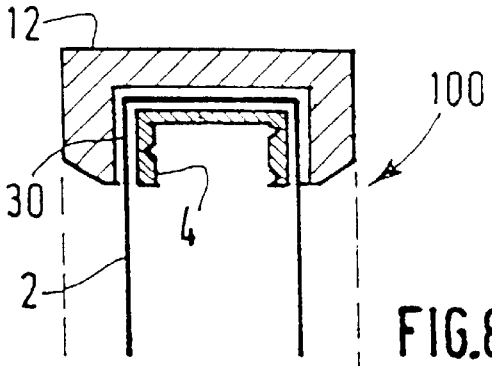
Figure 8A:
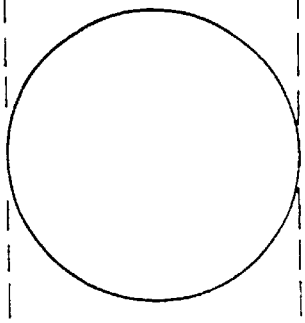
Figure 8B:
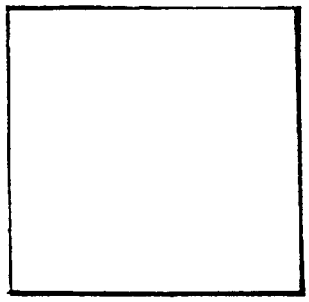
Figure 8C:
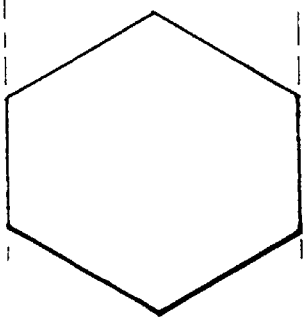

FIGS. 7 and 8 show a sectional view of the caps (100) obtained from the strip (900). These caps (100) are fitted with a plastic outer cap identical to that contained in the said heat sealed coat (30) by means of the said external coat (30). FIGS. 7 and 8 to 8*c* illustrate some non-limitative forms of these outer caps (12) with rounded head (FIG. 12) or flat head (FIGS. 8 to 8*c*), and in the cases shown with a circular section (FIG. 8*a*), square section (FIG. 8*b*) or hexagonal section (FIG. 8*c*).

DETAILED DESCRIPTION OF THE INVENTION

According to the invention, the said coat (3) fixing the said insert (4) and the said metal cap (2) to each other comprises a sufficient quantity of the said plastic material in the divided state to provide good bond in order to satisfy the problem that arises by heat sealing. Thus in the case in which the said insert is made of polyolefine preferably PE or PP, the said coat comprises at least 3% of the said polyolefine by weight.

Typically, the said bonding coat (3) is a heat sealing varnish comprising 5 to 30% by weight of the said polyolefine, so that it bonds simultaneously to the said insert (4) and the said metal cap (2).

Preferably, the said heat setting varnish is an epoxy varnish.

In this case, the said metal cap (2) comprises an inner coating (21) formed from a coat of epoxy varnish.

According to the invention, the said metal cap (2) is made of aluminum, iron, tin, or a multi-coat material comprising a metal inner coat.

Figure 1:
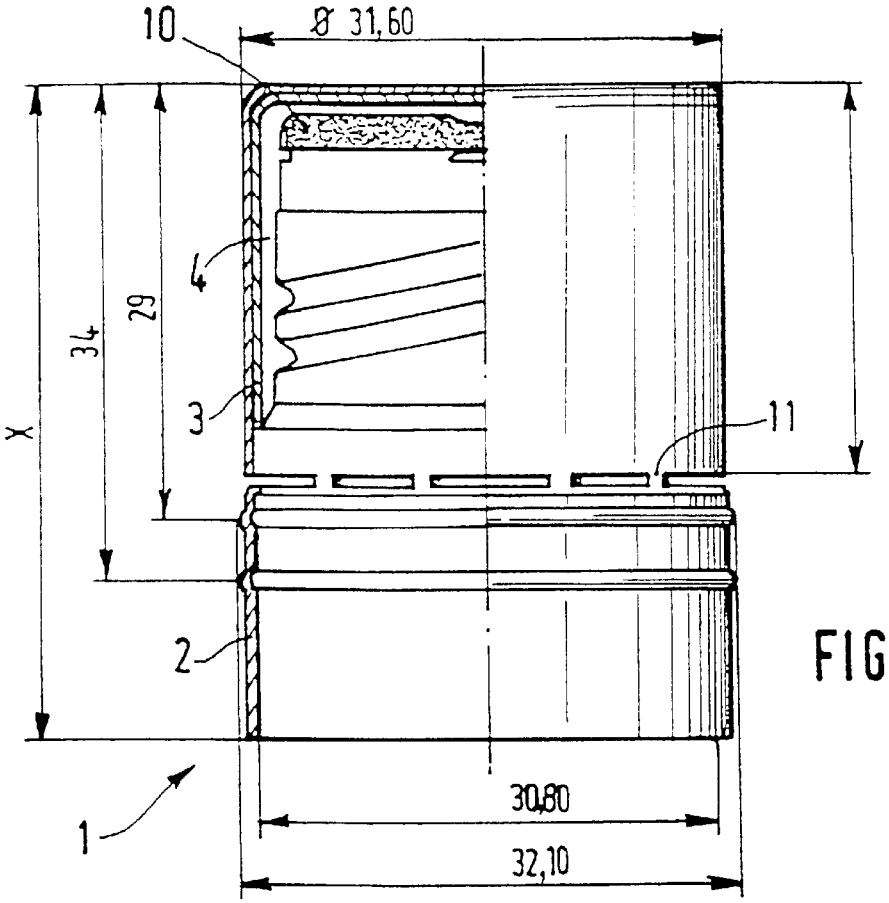
FIG. 1 shows an axial half-section of a cap (1) according to the invention comprising a metal cap (2) and an insert (4) attached to each other by a coat (3). A seal (10) is placed in the bottom of the insert (4). The skirt of cap (1) comprises a circular line of weakness composed of a series of bridges (11).
Figure 2:
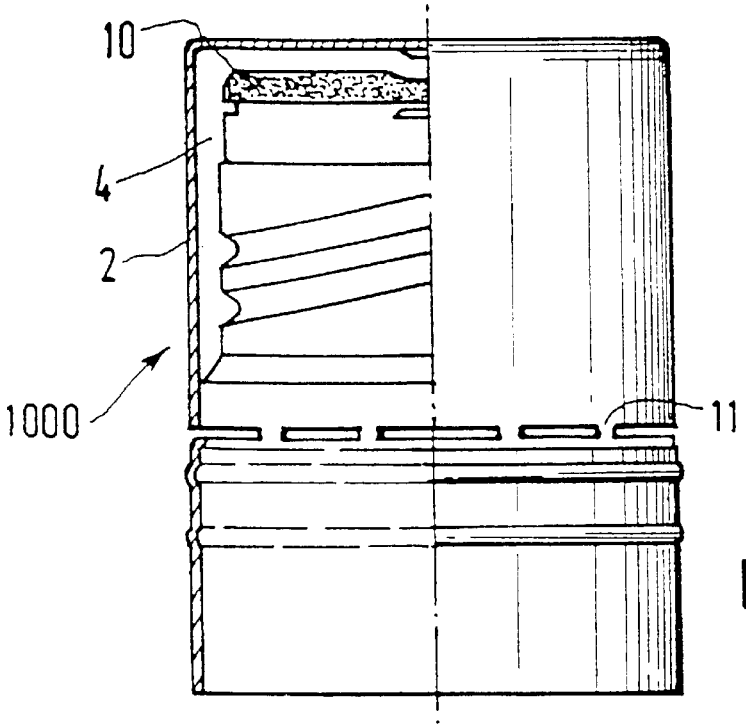
FIG. 2 shows a representation similar to that in FIG. 1, of a cap (1000) according to the state of the art.

According to one embodiment of the invention, the sealing cap (1) may comprise an add-on seal (10), as shown in FIG. 1. This seal, known in itself, is held in place at the bottom of the insert, typically by a circular groove.

According to another embodiment not shown in the figures, the sealing cap (1) may comprise a self-sealing insert instead of a seal (10), which provides the required seal by itself.

Furthermore, the cap (1) according to the invention may comprise means designed to facilitate opening for the first time, and preferably at least one line of weakness, or several lines of weakness forming a tear-off tab.

FIG. 1 shows a cap with the single line of weakness formed by a series of bridges (11) that are broken the first time that the bottle is opened.

Another purpose of the invention consists of the cap (1) manufacturing process according to the invention. In this process:

a) the metal strip or sheet (7) from which the said metal cap will be formed in a manner known in itself, is supplied, b) preferably, a coat of varnish (21) is formed on the entire "inner" surface of the said strip or sheet, designed to facilitate shaping of the said metal strip or sheet, particularly by stamping and drawing, c) the said bonding coat (3) is then formed on the said "inner" face which will eventually face all or some of the said insert, by spot coating, d) the sheet or strip (9) obtained in c) is then shaped in order to obtain the said metal cap (2) coated locally on the inside with the said bonding coat (3), in a manner known in itself, e) in the next step, the said insert (4) and the said metal cap (2) obtained in d) are assembled by thermoforming, in order to make the said coat (3) bond to the said insert (4).

This process is shown diagrammatically in FIGS. 3 to 5*e*.

According to another embodiment of the invention shown in FIGS. 6, 7 and 8 to 8*c*, a coat (30) similar to the said coat (3) can also be formed on the outside of the said metal cap. This is done by preparing a strip (90) according to FIG. 6, and corresponding to strip (9) in the previous embodiment, which comprises a coat (3) on one side of the strip and a coat (30) on the other side of the strip, at the same time.

Preferably, the outer cap (12) and the insert (4) are fixed to the said metal cap coated with the said coats (3) and (30) at the same time, by induction heating of the part of the said metal cap covered with the said coats (3) and (30).

The result is caps (100) as illustrated as examples in FIGS. 7 and 8 to 8*c*.

EXAMPLE EMBODIMENT

Caps (1) were made according to FIG. 1 with a height X equal to 60 mm, the other dimensions (in mm) of the cap being shown in FIG. 1.

This was done using a 210 $\mu$m thick strip of aluminum alloy in the 3000 series (Aluminum Association designation), both sides of which were varnished with an epoxy varnish at a coverage of 2.5 g/m$^2$.

A liquid varnish (82) was deposited by spot coating on the varnished aluminum strip (8) thus obtained, as illustrated in FIG. 4, in order to form the said coat (3) bonding to the metal cap (2) and thus form a strip (9) coated locally at predetermined locations with a coat (3) with a coverage of 8 g/m$^2$ of dry material.

The composition of this varnish is as follows:

87 parts of epoxy varnish as purchased in the shops, with 31% dry extract, 13 parts of PP dispersion as purchased in the shops (MORPRIME®) with 15% dry extract, giving a coat (3) containing about 6.7% by weight of PP, in addition to the stabilization additives (% by weight of dry material).

The strip thus coated was dried at 180° C. for 12 minutes.

The strip thus obtained was input into a conventional shaping device making use of stamping and drawing techniques, the said device cutting the blanks (90) that are fed into the stamping and drawing tool. The result was metal caps (2) partially coated on the inside of the said coat (3) as shown in FIG. 5*b*.

The threaded inserts made of PP, as shown in FIG. 5*c*, were supplied and were assembled to the metal caps (2) using a device comprising a punch (5) and a heating die (6) as shown in FIG. 5*d*.

The temperature T of the die (6) was 350° C., the pressure P exerted between the punch and the die being 120 daN and the time T being 0.15 s.

Other T, P, t conditions are possible, but it is important firstly to have a process with a high productivity, and secondly to choose a T-t pair such that the PP in the said coat (3) is softened sufficiently so that the PP in the coat (3) can bond to the said insert (4) without introducing any risk of damage to the said insert (4), particularly by excessive heat input.

A line of weakness was also formed by bridges (11) and a seal (10) was inserted.

The caps obtained according to the invention were tested on bottles containing liquors with a high sugar content. In all cases, the insert (4) remained fixed to the metal cap (2), unlike what was observed with caps according to the state of the art.

Other tests were carried out in which the coat (3) was formed facing only part of the insert: facing the head of the insert, and facing the skirt of the insert.

Mechanical separation tests showed that, as was predictable, the limiting torque causing separation between the insert (4) and the cap (2) varies depending on the extent and position of the coat (3) with respect to the insert (4); the torque is highest when the coat (3) covers the entire area of the insert, and is lower when the coat is applied facing the skirt (43) of the insert only, and is even lower when it is facing the head (42) of the insert.

The extent of the coat (3) can be chosen and can be limited as a function of the nature of the liquid contained, to satisfy the needs for each problem that arises.

Furthermore, caps according to the invention are not significantly more expensive than caps according to the state of the art; the cost of the materials forming the coat (3) is low considering the fact that the coat (3) is thin and that its surface area is limited, and the varnishing operation itself forms part of the standard manufacturing process.

What is claimed is:

1. Sealing cap for closing screw top receptacles comprising:

a metal cap having inner and outer surfaces, and including a head and a skirt;

a threaded insert formed of a plastic material disposed within the metal cap and fixed to the inner surface thereof; and an attachment means between the inner surface of the metal cap and the threaded plastic insert consisting essentially of a coating of said plastic material in a divided state in a thermosetting varnish bonded to at least a portion of the inner surface of the metal cap and heat sealed to the insert, said attachment means optionally including a layer thermosetting varnish disposed between the coating and the inner surface of the metal cap.

2. Cap according to claim 1, wherein the coating extends over the inner surface of the metal cap in its entirety.

3. Cap according to claim 1, wherein the plastic material is a polyolefin, and the coating comprises at least 3% by weight of said polyolefin.

4. Cap according to claim 3, wherein the polyolefin is polyethylene or polypropylene.

5. Cap according to claim 3, wherein the coating comprises 5 to 30% by weight of said polyolefin.

6. Cap according to claim 5, wherein the varnish is an epoxy varnish.

7. Cap according to claim 1, additionally comprising a layer of an epoxy varnish disposed between the inner surface of the metal cap and said coating.

8. Cap according to claim 1, wherein the metal cap comprises aluminum, iron, tin, or a multi-layer material comprising a metal inner layer.

9. Cap according to claim 8, further comprising an add-on seal disposed within the cap.

10. Cap according to claim 9, wherein the add-on seal comprises a self-sealing system.

11. Cap according to claim 1, further comprising means for facilitating a first removal of the cap from a bottle which is sealed by the cap.

12. Cap according to claim 11, wherein the means for facilitating comprises at least one line of weakness.

13. Cap according to claim 1, further comprising an outer cap heat sealed to the outer surface of the metal cap.

14. Process for manufacturing a sealing cap comprising a metal cap having inner and outer surfaces, and including a head and a skirt, and a threaded insert formed of a plastic material disposed within the metal cap and fixed to the inner surface thereof, comprising the steps of:

a) supplying a metal strip or sheet from which the metal cap will be formed;

b) applying a coat of thermosetting varnish over one surface of the strip or sheet in its entirety, to facilitate shaping of the strip or sheet;

c) applying over at least a portion of the coat of varnish a bonding coat;

d) shaping the strip or sheet to obtain the metal cap coated on the inner surface thereof by the bonding coat; and e) assembling the insert and the metal cap, and thermoforming to cause the bonding coat to bond the insert to the inner surface of the metal cap, wherein the bonding coat consists essentially of said plastic material in a divided state in a thermosetting varnish.

* * * * *